US006484965B1

(12) United States Patent
Reaves

(10) Patent No.: US 6,484,965 B1
(45) Date of Patent: Nov. 26, 2002

(54) PAPER ROLL STORAGE AND PAPER TOWEL DISPENSER

(76) Inventor: Shatonie L. Reaves, 1911 Autumn Ct., Greensboro, NC (US) 27405

( * ) Notice: Subject to any disclaimer, the term of this patent is extended or adjusted under 35 U.S.C. 154(b) by 0 days.

(21) Appl. No.: 09/802,547

(22) Filed: Mar. 9, 2001

(51) Int. Cl.[7] ..... B65H 19/00; B65H 67/00

(52) U.S. Cl. ..... 242/560; 242/560.2

(58) Field of Search ..... 242/560, 560.2

(56) References Cited

U.S. PATENT DOCUMENTS 6,302,350 B1 * 10/2001 Burrell et al. ..... 242/560

* cited by examiner

*Primary Examiner*—Donald P. Walsh
*Assistant Examiner*—Jonathan R. Miller

(57) ABSTRACT

A paper roll storage and paper towel dispenser for storing rolls of paper and dispensing towels therefrom in a space-saving manner. The paper roll storage and paper towel dispenser includes a container assembly including a container having a bottom wall, side walls, a front wall, and an open top; and also including a lid assembly including a lid being hingedly attached to the container and being closeable over the open top, and also including a handle securely attached to the lid; and further includes a bracket assembly being securely attached to the container for supporting a roll of paper thereupon.

10 Claims, 2 Drawing Sheets

PAPER ROLL STORAGE AND PAPER TOWEL DISPENSER

BACKGROUND OF THE INVENTION

1. Field of the Invention

The present invention relates to a paper towel storage and dispenser and more particularly pertains to a new paper roll storage and paper towel dispenser for storing rolls of paper and dispensing towels therefrom in a space-saving manner.

2. Description of the Prior Art

The use of a paper towel storage and dispenser is known in the prior art. More specifically, a paper towel storage and dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,887,818; 4,177,958; 2,991,951; 4,363,454; 3,039,709; and U.S. Pat. No. Des. 293,056.

While these devices fulfill their respective, particular objectives and requirements, the aforementioned patents do not disclose a new paper roll storage and paper towel dispenser. The inventive device includes a container assembly including a container having a bottom wall, side walls, a front wall, and an open top; and also including a lid assembly including a lid being hingedly attached to the container and being closeable over the open top, and also including a handle securely attached to the lid; and further includes a bracket assembly being securely attached to the container for supporting a roll of paper thereupon.

In these respects, the paper roll storage and paper towel dispenser according to the present invention substantially departs from the conventional concepts and designs of the prior art, and in so doing provides an apparatus primarily developed for the purpose of storing rolls of paper and dispensing towels therefrom in a space-saving manner.

SUMMARY OF THE INVENTION

In view of the foregoing disadvantages inherent in the known types of paper towel storage and dispenser now present in the prior art, the present invention provides a new paper roll storage and paper towel dispenser construction wherein the same can be utilized for storing rolls of paper and dispensing towels therefrom in a space-saving manner.

The general purpose of the present invention, which will be described subsequently in greater detail, is to provide a new paper roll storage and paper towel dispenser which has many of the advantages of the paper towel storage and dispenser mentioned heretofore and many novel features that result in a new paper roll storage and paper towel dispenser which is not anticipated, rendered obvious, suggested, or even implied by any of the prior art paper towel storage and dispenser, either alone or in any combination thereof.

To attain this, the present invention generally comprises a container assembly including a container having a bottom wall, side walls, a front wall, and an open top; and also including a lid assembly including a lid being hingedly attached to the container and being closeable over the open top, and also including a handle securely attached to the lid; and further includes a bracket assembly being securely attached to the container for supporting a roll of paper thereupon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paper roll storage and paper towel dispenser which has many of the advantages of the paper towel storage and dispenser mentioned heretofore and many novel features that result in a new paper roll storage and paper towel dispenser which is not anticipated, rendered obvious, suggested, or even implied by any of the prior art paper towel storage and dispenser, either alone or in any combination thereof.

It is another object of the present invention to provide a new paper roll storage and paper towel dispenser which may be easily and efficiently manufactured and marketed.

It is a further object of the present invention to provide a new paper roll storage and paper towel dispenser which is of a durable and reliable construction.

An even further object of the present invention is to provide a new paper roll storage and paper towel dispenser which is susceptible of a low cost of manufacture with regard to both materials and labor, and which accordingly is then susceptible of low prices of sale to the consuming public, thereby making such paper roll storage and paper towel dispenser economically available to the buying public.

Still yet another object of the present invention is to provide a new paper roll storage and paper towel dispenser which provides in the apparatuses and methods of the prior art some of the advantages thereof, while simultaneously overcoming some of the disadvantages normally associated therewith.

Still another object of the present invention is to provide a new paper roll storage and paper towel dispenser for storing rolls of paper and dispensing towels therefrom in a space-saving manner.

Yet another object of the present invention is to provide a new paper roll storage and paper towel dispenser which includes a container assembly including a container having a bottom wall, side walls, a front wall, and an open top; and also including a lid assembly including a lid being hingedly attached to the container and being closeable over the open top, and also including a handle securely attached to the lid; and further includes a bracket assembly being securely attached to the container for supporting a roll of paper thereupon.

Still yet another object of the present invention is to provide a new paper roll storage and paper towel dispenser that provides convenient and quick access to paper rolls and towels when needed.

Even still another object of the present invention is to provide a new paper roll storage and paper towel dispenser that is easy and convenient to use in small kitchens and in hosptials where storage space is a premium.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
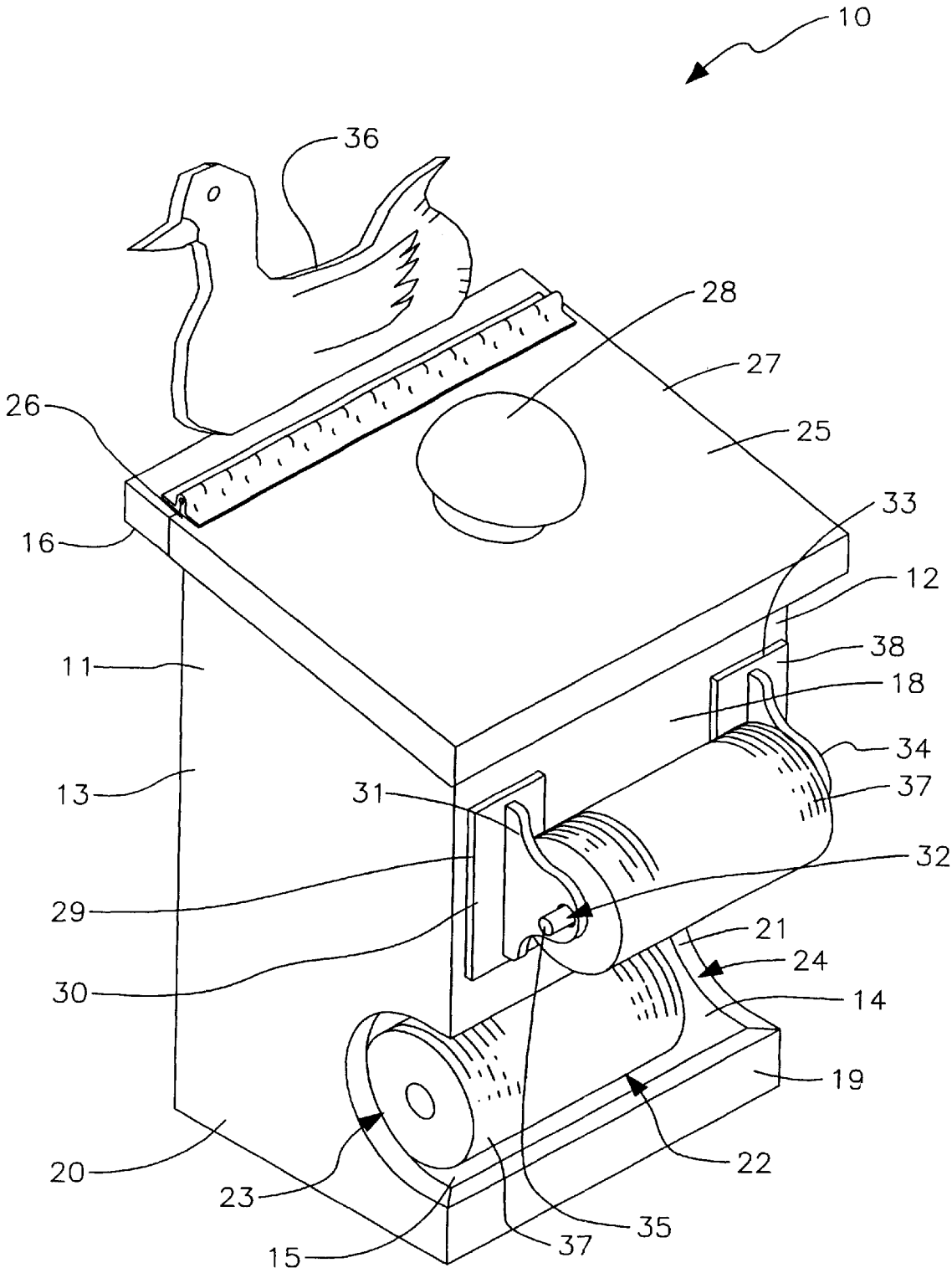
FIG. 1 is a perspective view of a new paper roll storage and paper towel dispenser according to the present invention.
Figure 3:
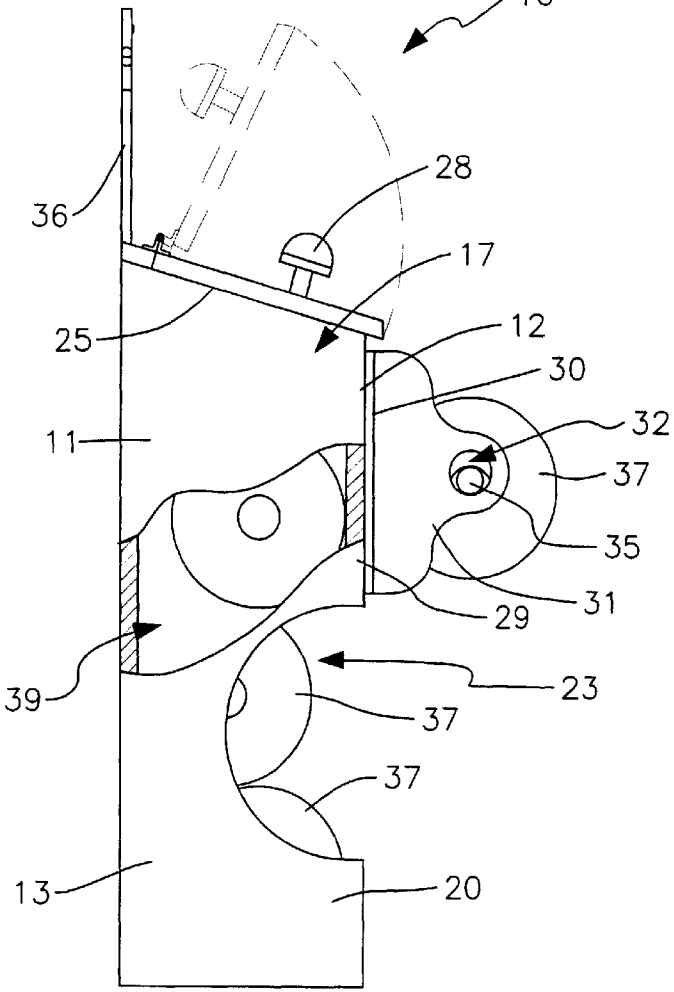
FIG. 3 is a side elevational view of the present invention.
Figure 2:
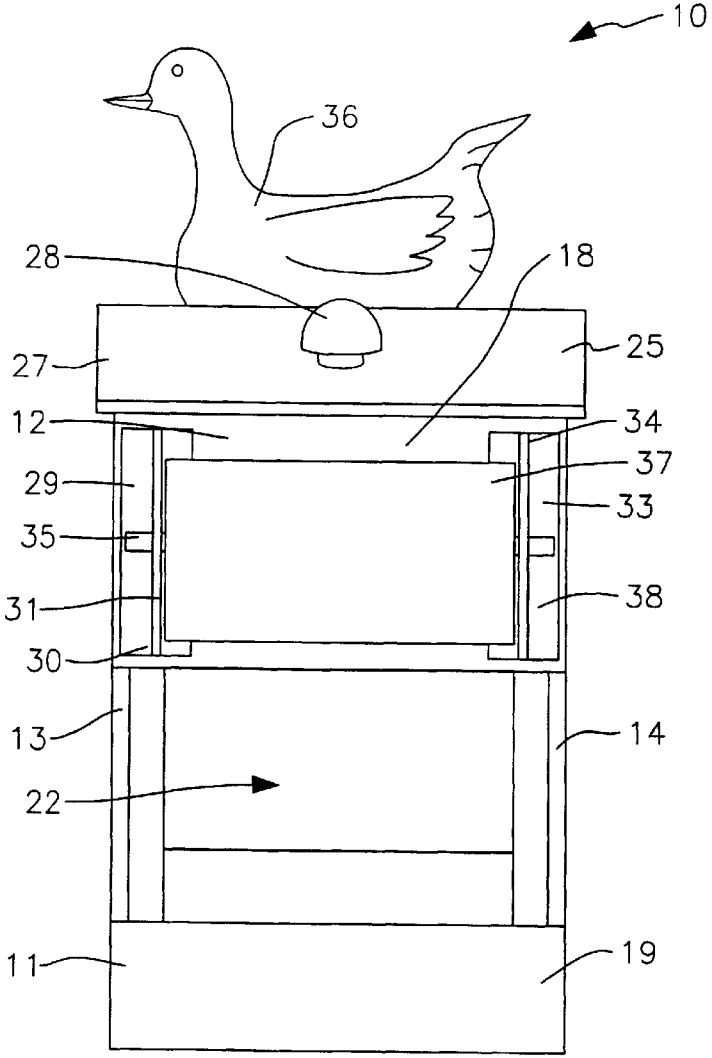
FIG. 2 is a front elevational view of the present invention.

With reference now to the drawings, and in particular to FIGS. 1 through 3 thereof, a new paper roll storage and paper towel dispenser embodying the principles and concepts of the present invention and generally designated by the reference numeral 10 will be described.

As best illustrated in FIGS. 1 through 3, the paper roll storage and paper towel dispenser 10 generally comprises a container assembly including a container 11 having a bottom wall 15, side walls 13,14, a front wall 12, and an open top 17 with the container 11 including a storage compartment 39 disposed therein and being adapted to store rolls of paper 37 therein. The front wall 12 of the container has an upper portion 18 and a lower portion 19 which has an opening 22 therethrough with the opening 22 being adapted to remove rolls of paper 37 from the storage compartment 39. Each of the side walls 13,14 has an upper portion and a lower portion 20 which has a slot 23,24 disposed through a front longitudinal end thereof. The slots 23,24 of the side walls 13,14 are aligned with and disposed in the opening 22 in the front wall 12 to facilitate removal of the rolls of paper 37 through the opening 22. The slots 23,24 are also curved to allow easy access to the rolls of paper 37 being stored in the storage compartment 39. Each of the side walls 13,14 has a top end which is slanted downwardly from a back wall 16 to the front wall 12 of the container 11. The container assembly also includes a decorative structure 36 being securely and conventionally attached upon a top of the back wall 16 of the container 11 with the decorative structure 36 being shaped like that of a duck or goose. The container 11 is approximately 20½ inches tall and 23½ inches wide.

A lid assembly includes a lid 25 being hingedly and conventionally attached to the container 11 and being closeable over the open top 17, and also includes a mushroom-shaped handle 28 being securely and conventionally attached to the lid 25 with the lid 25 having a back end 26 which is hingedly attached to a top of the back wall 16 of the container 11, and having a top surface 27. The handle 28 is securely and conventionally attached to the top surface 27 of the lid 25 for facilitating opening and closing of the lid 25 upon the container 11.

A bracket assembly is securely and conventionally attached to the container 11 for supporting a roll of paper 37 thereupon with the bracket assembly including bracket members 29,33 being spaced apart and being securely and conventionally attached to an exterior of the upper portion 18 of the front wall 12 of the container 11, and also including a spool 35 being rotatably supported by the bracket members 29,33. The spool 35 is adapted to support a roll of paper 37 for dispensing sheets of paper from the roll. Each of the bracket members 29,33 includes a base 30,38 being securely attached to the exterior of the upper portion 18 of the front wall 12, and also includes a spool support member 31,34 being securely and conventionally attached to the base 30,38 and extending outwardly thereof and having a hole 32 disposed through an end portion thereof and being adapted to receive an end portion of the spool 35 In use, the user would place the paper roll storage and paper towel dispenser 10 conveniently upon a counter within easy reach of the user, and would open the lid 25 and place rolls of paper 37 in the storage compartment 39 with one roll of paper being placed upon the spool 35 so that sheets of paper can be removed from the roll of paper for use by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paper roll storage and paper towel dispenser comprising:

a container assembly including a container a bottom wall, side walls, a front wall, and an open top, said container including a storage compartment being disposed therein and being adapted to store rolls;

a lid assembly including a lid being hingedly attached to said container and being closeable over said open top, and also including a handle attached to said lid;

a bracket assembly attached to said container for supporting a roll of paper thereupon;

wherein said front wall of said container has an upper portion and a lower portion defining an opening therebetween for accessing rolls in said storage compartment; and wherein said lower portion of said front wall forms a lip for retaining rolls in an interior of said container assembly.

2. A paper roll storage and paper towel dispenser as described in claim 1, wherein each of said side walls has an upper portion and a lower portion which has a slot disposed through a front longitudinal end thereof, said slots of said side walls being aligned with and disposed in said opening in said front wall to facilitate removal of the rolls of paper through said opening.

3. A paper roll storage and paper towel dispenser as described in claim 2, said slots are curved to allow easy access to the rolls of paper being stored in said storage cabinet.

4. A paper roll storage and paper towel dispenser as described in claim 3, wherein said lid has a back end which is hingedly attached to a top of a back wall of said container, and has a top surface, said handle being securely attached to said top surface of said lid for facilitating opening and closing of said lid upon said container.

5. A paper roll storage and paper towel dispenser as described in claim 4, wherein said bracket assembly includes bracket members being spaced apart and being securely attached to an exterior of said upper portion of said front wall of said container, and also includes a spool being rotatably supported by said bracket members, said spool being adapted to support a roll of paper for dispensing sheets of paper from the roll.

6. A paper roll storage and paper towel dispenser as described in claim 5, wherein each of said bracket members includes a base being securely attached to said exterior of said upper portion of said front wall, and also includes a spool support member being securely attached to said base and extending outwardly thereof and having a hole disposed through an end portion thereof and being adapted to receive an end portion of said spool.

7. A paper roll storage and paper towel dispenser as described in claim 6, wherein each of said side walls has a top end which is slanted downwardly from said back wall to said front wall of said container.

8. A paper roll storage and paper towel dispenser as described in claim 7, wherein said container assembly also includes a decorative structure securely attached upon a top of said back wall of said container, said decorative structure being shaped like that of a duck or goose.

9. A paper roll storage and paper towel dispenser as described in claim 1, wherein said bracket assembly is mounted on said front wall for positioning a roll in front of said container.

10. A paper roll storage and paper towel dispenser comprising:

a container assembly including a container a bottom wall, side walls, a front wall, and an open top, said container including a storage compartment disposed therein and being adapted to store rolls of paper, said front wall of said container having an upper portion and a lower portion defining an opening therebetween for accessing rolls in said storage compartment, said lower portion of said front wall forming a lip for retaining rolls in an interior of said container assembly, each of said side walls having an upper portion and a lower portion which having a slot being disposed through a front longitudinal end thereof, said slots of said side walls being aligned with and disposed in said opening in said front wall to facilitate removal of the rolls of paper through said opening, said slots being curved to allow easy access to the rolls of paper being stored in said storage compartment, each of said side walls having a top end which is slanted downwardly from a back wall to said front wall of said container, said container assembly also including a decorative structure attached upon a top of said back wall of said container, said decorative structure being shaped like that of a duck or goose, said container being approximately 20½ inches tall and 23½ inches wide;

a lid assembly including a lid being hingedly attached to said container and being closeable over said open top, and also including a handle attached to said lid, said lid having a back end which is hingedly attached to a top of said back wall of said container, and has a top surface, said handle being attached to said top surface of said lid for facilitating opening and closing of said lid upon said container; and a bracket assembly being attached to said container for supporting a roll of paper thereupon, said bracket assembly being mounted on said front wall for positioning a roll in front of said container, said bracket assembly including bracket members being spaced apart and being attached to an exterior of said upper portion of said front wall of said container, and also including a spool being rotatably supported by said bracket members, said spool being adapted to support a roll of paper for dispensing sheets of paper from the roll, each of said bracket members including a base being securely attached to said exterior of said upper portion of said front wall, and also including a spool support member being securely attached to said base and extending outwardly thereof and having a hole disposed through an end portion thereof and being adapted to receive an end portion of said spool.

* * * * *